US007209688B2

(12) United States Patent
Arai

(10) Patent No.: US 7,209,688 B2
(45) Date of Patent: Apr. 24, 2007

(54) TONER CONTAINER

(75) Inventor: Takashi Arai, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 15 days.

(21) Appl. No.: 10/445,259

(22) Filed: May 27, 2003

(65) Prior Publication Data

US 2003/0228176 A1 Dec. 11, 2003

(30) Foreign Application Priority Data

Jun. 11, 2002 (JP) ..... 2002-170163

(51) Int. Cl.
*G03G 15/08* (2006.01)

(52) U.S. Cl. ..... 399/262

(58) Field of Classification Search ..... 399/262; 220/592.25, 62.22; 428/694 TR
See application file for complete search history.

(56) References Cited

U.S. PATENT DOCUMENTS 4,855,204 A * 8/1989 Fujii et al.
5,104,702 A * 4/1992 Ohachi
5,245,391 A * 9/1993 Suzuki et al. ..... 399/285

FOREIGN PATENT DOCUMENTS

JP 59143170 A * 8/1984
JP 02131276 A * 5/1990
JP 05169566 A * 7/1993
JP 5-341647 12/1993
JP 06149053 A * 5/1994
JP 09327888 A * 12/1997
JP 2000075648 A * 3/2000
JP 2000298394 A * 10/2000

OTHER PUBLICATIONS

Translation of JP 59-143170.*

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

To prevent degradation in printing precision with low cost even when a toner container is exposed to a high-temperature atmosphere, the toner container includes a resin molded article having a heat-insulating layer in it. The toner container may be multilayered, wherein at least one layer is a resin material including a heat-insulating material. The toner container may also be a resin molded article including a foam layer. The toner container may have a toner-filled-side surface, which is a fine-discontinuous-microstructure surface and a surface thereof not in contact with the toner, which is a smooth surface.

2 Claims, 12 Drawing Sheets

FIG. 7

| INSULATING MATERIAL | PACKING WEIGHT % | RESIN MATERIAL | MOLDING METHOD (1) | MOLDING METHOD (2) |
|---|---|---|---|---|
| GLASS BALLOONS | 25 | HIPS, PC/ABS PPE, PPE+PS, ABS | INJECTION MOLDING | |
| MULLITE | 25 | HIPS, PC/ABS PPE, PPE+PS, ABS | INJECTION MOLDING | |
| SILICA | 25 | HIPS, PC/ABS PPE, PPE+PS, ABS | INJECTION MOLDING | |
| WOOD PIECES | 15 | HIPS, PC/ABS PPE, PPE+PS, ABS | INJECTION MOLDING | TWO-COLOR MOLDING |
| BAMBOO FIBERS | 15 | HIPS, PC/ABS PPE, PPE+PS, ABS | INJECTION MOLDING | TWO-COLOR MOLDING |
| PAPER PIECES | 10 | HIPS, PC/ABS PPE, PPE+PS, ABS | INJECTION MOLDING | TWO-COLOR MOLDING |
| METHANE GAS | 4 | HIPS, PC/ABS PPE, PPE+PS, ABS | INJECTION MOLDING | SANDWICH MOLDING |
| BUTANE GAS | 4 | HIPS, PC/ABS PPE, PPE+PS, ABS | INJECTION MOLDING | SANDWICH MOLDING |
| CARBON DIOXIDE GAS | 5 | HIPS, PC/ABS PPE, PPE+PS, ABS | INJECTION MOLDING | SANDWICH MOLDING |
| NITROGEN GAS | 2 | HIPS, PC/ABS PPE, PPE+PS, ABS | INJECTION MOLDING | SANDWICH MOLDING |
| ARGON GAS | 5 | HIPS, PC/ABS PPE, PPE+PS, ABS | INJECTION MOLDING | SANDWICH MOLDING |

FIG. 8

| INSULATING MATERIAL | RESIN MATERIAL | LOAD TEMPERATURE °C | COUNTER-TONER -SIDE SURFACE TEMPERATURE °C | TONER-SIDE SURFACE TEMPERATURE °C |
|---|---|---|---|---|
| NONE ( PRIOR ART ARTICLE ) | HIPS, PPE+PS | 60 | 60 | 56 |
| GLASS BALLOONS | HIPS, PPE+PS | 60 | 60 | 50 |
| MULLITE | HIPS, PPE+PS | 60 | 60 | 48 |
| SILICA | HIPS, PPE+PS | 60 | 60 | 47 |
| WOOD PIECES | HIPS, PPE+PS | 60 | 60 | 48 |
| BAMBOO FIBERS | HIPS, PPE+PS | 60 | 60 | 47 |
| PAPER PIECES | HIPS, PPE+PS | 60 | 60 | 48 |
| METHANE GAS | HIPS, PPE+PS | 60 | 60 | 41 |
| BUTANE GAS | HIPS, PPE+PS | 60 | 60 | 40 |
| CARBON DIOXIDE GAS | HIPS, PPE+PS | 60 | 60 | 41 |
| NITROGEN GAS | HIPS, PPE+PS | 60 | 60 | 41 |
| ARGON GAS | HIPS, PPE+PS | 60 | 60 | 42 |

TONER CONTAINER

FIELD OF THE INVENTION

The present invention relates to a toner container used in a copying machine or printer.

BACKGROUND OF THE INVENTION

Conventionally, to manufacture a toner container, several types of components are molded from a resin material such as polystyrene in accordance with injection molding, are then filled with toner, and are assembled. To fix the toner on paper or the like, a high temperature of 180° C. to 280° C. and a pressure of 2 kg to 7 kg are applied. In recent years, due to the requirements for energy conservation and higher quality, the particle size of the toner has decreased remarkably, and a heat fusion temperature for the toner has also decreased, so the fixing temperature tends to decrease consequently.

As the nature of the toner changes, two major problems anse. One problem is agglomeration accompanying a particle size decrease of the toner. The higher the temperature and humidity, the more clearly agglomeration occurs. When the toner agglomerates, it causes printing precision degradation such as a change in line width of printed characters. The other problem is as follows. To decrease the fixing temperature, the fusion temperature of the toner itself cannot but be decreased. Hence, when the toner container is exposed to a high-temperature atmosphere, the toner fuses to degrade the printing precision simultaneously.

Conventionally, to prevent a temperature increase in the toner container, the toner container is packaged a number of times. For transport, a temperature-adjustable trailer or the like is used. Also, a fan for decreasing the internal temperature is attached to the main body of a printer or copying machine which is to incorporate the toner container. In either case, however, the cost is high, thus degrading the productivity.

SUMMARY OF THE INVENTION

The present invention has been made in view of the problems described above, and has as its object to prevent a degradation in printing precision at a low cost even when the toner container is exposed to a high-temperature atmosphere.

In order to solve the above problems and to achieve the above object, according to the first aspect of the present invention, a toner container is characterized by comprising a resin molded article having a heat-insulating layer therein.

According to the second aspect of the present invention, a toner container is characterized in that not less than two layers are formed in a direction of thickness, and not less than one of the not less than two layers is made of a resin material including a heat-insulating material.

According to the third aspect of the present invention, a toner container is characterized by comprising a resin molded article including a foam layer.

According to the fourth aspect of the present invention, a toner container is characterized by comprising a resin molded article including a large number of cells each having a diameter of 5 μm to 100 μm.

According to the fifth aspect of the present invention, a toner container is characterized by comprising a resin molded article which includes a foam layer and has an outer surface with a wrinkle pattern having an arithmetic average coarseness of 4 μm to 10 μm, a 10-point average coarseness of 15 μm to 35 μm, and an average surface microstructure gap of 150 μm to 350 μm.

According to the sixth aspect of the present invention, a toner container is in that a toner-filled-side a surface of the toner container is a fine-discontinuous-microstructure surface and a surface thereof which does not come into contact with toner is a smooth surface, and the toner container includes a foam layer.

According to the seventh aspect of the present invention, a toner container is characterized in that a surface that is exposed externally and a surface that is not exposed externally have different surface coarsenesses, and the toner container includes a foam layer.

According to the eighth aspect of the present invention, a toner container is characterized in that welding surfaces or adhesion surfaces of at least two molded components that form the toner container are smooth surfaces, a toner-filled-side surface of the toner container is a fine-discontinuous-microstructure surface, and the toner container includes a foam layer.

According to the ninth aspect of the present invention, a toner container is characterized by comprising a resin molded article which includes a foam layer and has an outer surface partly forming a smooth surface and another surface being a fine-discontinuous-microstructure surface.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 7 is a table showing the types of heat-insulating materials;

FIG. 8 is a table showing temperature differences between the interior and exterior of the toner container according to different conditions;

DETAILED DESCRIPTION OF THE PREFERRED EMBODIMENT

A preferred embodiment of the present invention will be described in detail with reference to the accompanying drawings.

Figure 1:
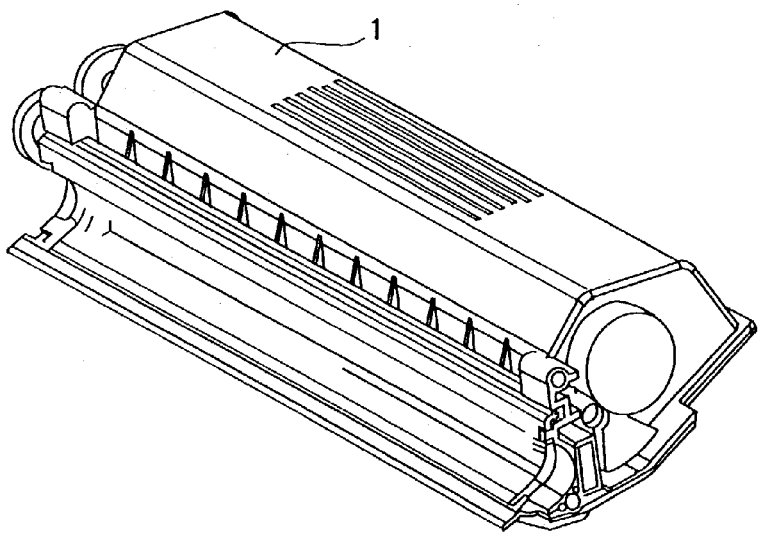
FIG. 1 is a view showing an entire toner container according to an embodiment of the present invention.

FIG. 1 is a view showing a toner container according to one embodiment of the present invention.

Referring to FIG. 1, reference numeral 1 denotes a plastic toner container. The toner container 1 is filled with micron-sized toner.

Figure 2:
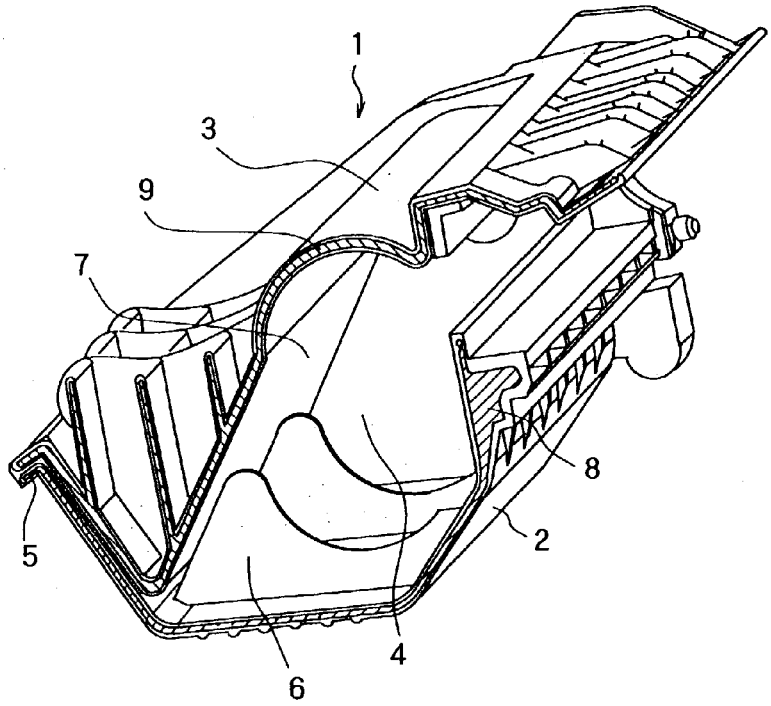
FIG. 2 is a sectional view of the toner container shown in FIG. 1.

FIG. 2 is a sectional view of the toner container of this embodiment.

Referring to FIG. 2, reference numerals 2 and 3 denote resin components molded individually; 4, a space to be filled with the toner; 5, a bonded surface through which the resin components 2 and 3 are bonded; 6 and 7, toner-filled-side surfaces of the resin components 2 and 3, respectively; and 8 and 9, heat-insulating layers.

The arrangement will be described with reference to FIG. 2.

The resin components 2 and 3 are molded by injection molding. When performing injection molding, a heat-insulating material for forming a heat-insulating layer is mixed in the resin material. As the heat-insulating material to form a layer or be dispersed in the resin, a ceramic material such as glass balloon or low-specific-gravity multi or silica, an organic material such as wood pieces, bamboo fibers, or paper pieces, or a foam using methane, butane, carbon dioxide, nitrogen, or argon gas was used, as shown in FIG. 7. To form the heat-insulating layer in a layer form by lamination, sandwich molding and two-color molding were used. The resin components processed in this manner and including the heat-insulating layer of this example are bonded through the bonded surface 5. Bonding is performed by ultrasonic welding, but an adhesive or thermal fusing may be used instead. The resin components are integrated by bonding to form a container. Then, the container is filled with toner, so the toner-filled-side surfaces 6 and 7 are in contact with the toner.

Figure 3:
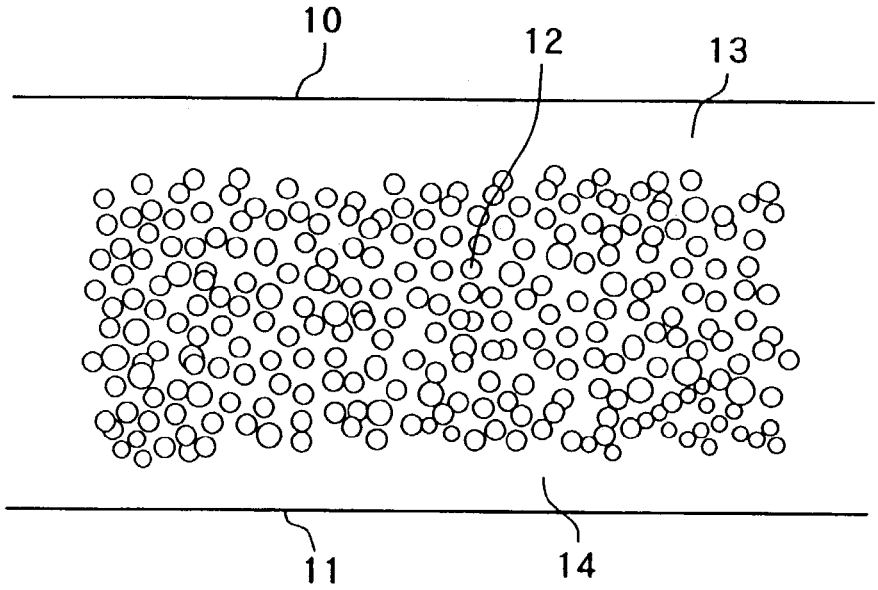
FIG. 3 is a detailed enlarged sectional view of a toner container including a heat-insulating layer.

FIG. 3 is a detailed enlarged sectional view of the toner container including the heat-insulating layer of this example.

Referring to FIG. 3, reference numeral 10 denotes a container surface which is not to be in contact with the toner; 11, a container surface which is to be in contact with the toner; 12, a heat-insulating layer; and 13 and 14, skin layers present between the container surfaces and the heat-insulating layer.

The operation will be described with reference to FIG. 3.

Heat outside the toner container 1 is transferred to the container surface 10 and then through the skin layer 13. Then, the heat reaches the heat-insulating layer 12, and its heat transfer speed becomes excessively low due to the low heat transfer coefficient and low thermal conductivity which are the characteristics of the heat-insulating layer. The heat is partly transferred through a resin portion having very little heat-insulating layer, and reaches the skin layer 14. After being transferred through the skin layer 14, the heat reaches the toner-side surface 11. As the heat transfer speed and efficiency become very low due to the presence of the heat-insulating layer 12, a temperature difference occurs between the counter-toner-side surface 10 and the toner-side surface 11.

FIG. 8 shows temperature differences according to different conditions.

It is seen that in any toner container including the heat-insulating layer of this example, the temperature on the toner side is lower than in the conventional container. Regarding the atmosphere where the toner is placed, it is anticipated to be about 60° C. if the toner container is transported through desert overland. The toner in the container agglomerates at about 45° C. to 55° C., although it depends on the type of toner. With the toner container including the heat-insulating layer of this example, the toner will not agglomerate.

Figure 4:
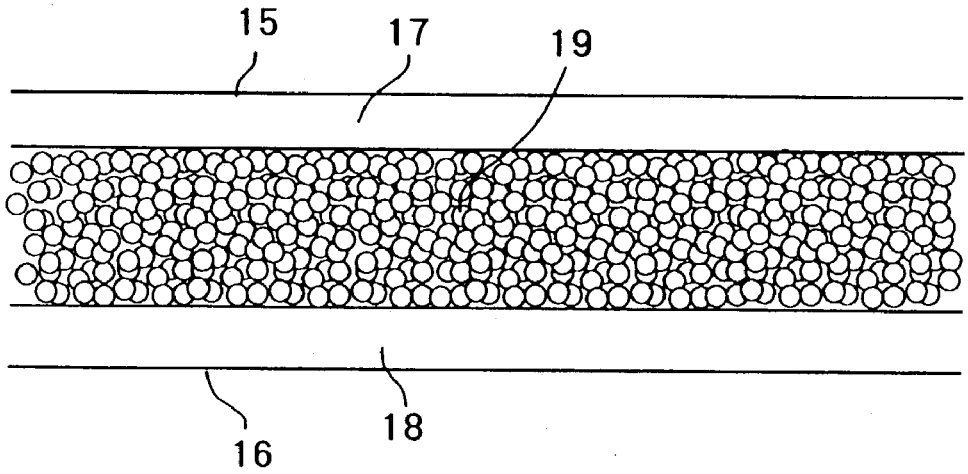
FIG. 4 is a sectional view of a toner container a heat-insulating layer of which is in a layer form.

FIG. 4 is a sectional view of a toner container a heat-insulating layer of which is in a layer form.

Referring to FIG. 4, reference numeral 15 denotes a container surface which is not to be in contact with the toner; 16, a container surface which is to be in contact with the toner; 19, a core layer serving as a heat-insulating layer; and 17 and 18, skin layers present between the container surfaces and the heat-insulating layer. More specifically, this container is comprised of three layers, i.e., the resin layer 17, the heat-insulating layer 19, and the resin layer 18 in the direction of thickness.

According to this embodiment, to form such three-layer arrangement, a sandwich injection molding apparatus which is generally used is used. First, a resin for forming the resin layers 17 and 18 is injected into a mold, and a heat-insulating material is injected into the mold, thus obtaining a three-layer arrangement. In this arrangement, as the boundaries between the resin layers and heat-insulating layer are clear, the heat transfer performance could be decreased to be much lower than with the arrangement of FIG. 3 described above.

Figure 5:
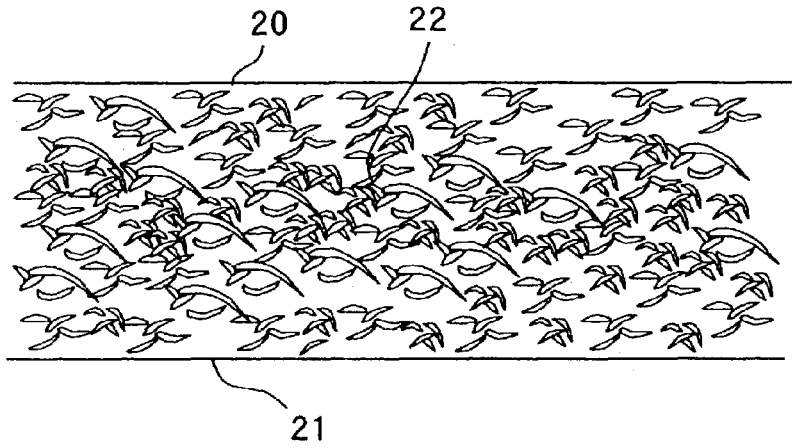
FIG. 5 is a detailed enlarged sectional view of a toner container including a heat-insulating layer according to another example of the present invention.

FIG. 5 is a detailed enlarged sectional view of a toner container including a heat-insulating layer according to another example of the present invention.

Referring to FIG. 5, reference numeral 20 denotes a container surface which is not to be in contact with the toner; 21, a container surface which is to be in contact with the toner; and 22, a heat-insulating material for forming a heat-insulating layer. The heat-insulating material 22 is an organic substance such as paper pieces, wood pieces, or bamboo fibers. When the heat-insulating material 22 is dispersed in the resin material, the thermal conductivity in the direction of thickness can be decreased. The paper pieces, wood pieces, or bamboo fibers are formed of a very thin fibrous material, and accordingly have very small cells in them. The cells increase the heat-insulating effect.

Figure 6:
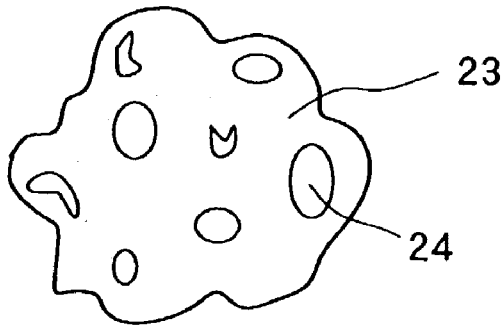
FIG. 6 is a view showing a ceramic-based heat-insulating material which forms a heat-insulating layer according to still another example of the present invention.

FIG. 6 is a view showing a ceramic-based heat-insulating material which forms a heat-insulating layer according to still another example of the present invention.

Referring to FIG. 6, reference numeral 23 denotes a ceramic-based heat-insulating material; and 24, a hole. The ceramic-based heat-insulating material used in this example is formed of particles each with a size of several μm, and has many cells on the surfaces of the particles and in the particles. Typical examples of such ceramic-based heat-insulating material are multi and silica. When the heat-insulating material was dispersed in a resin to form a toner container, a heat-insulating effect as shown in FIG. 8 could be obtained.

Figure 9:
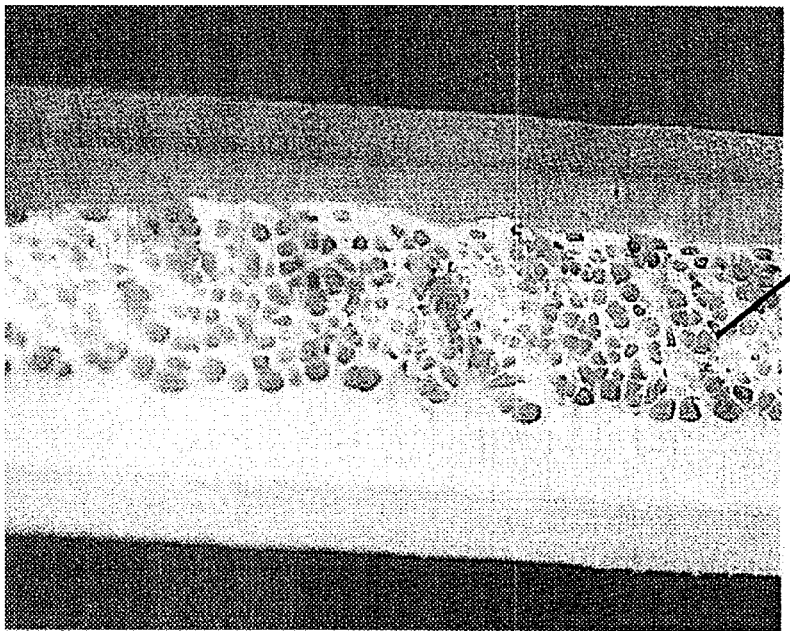
FIG. 9 is a sectional picture of a toner container.

FIG. 9 is a sectional picture of a toner container according to this embodiment. A foam layer is formed near the center of the thickness. As the foam layer contains gas, it has a high heat-insulating effect. Accordingly, an increase in internal temperature of the toner-filled side is very small as compared to the external temperature, as shown in FIG. 8. To form such foam layer, foam injection molding is used. When a foaming material is mixed in a resin and the resultant resin is fused and filled in the mold, a foam layer is formed by chemical reaction or heat-insulating expansion.

Figure 10:
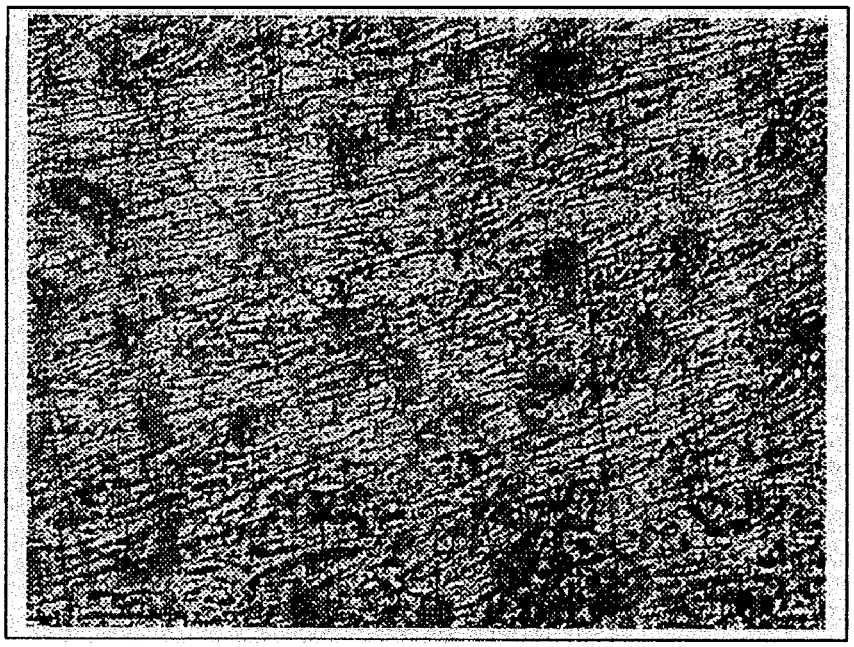
FIG. 10 is a picture of the surface state obtained when foam molding is employed for forming a heat-insulating layer.

FIG. 10 is a picture of the surface state obtained when foam molding is employed for forming a heat-insulating layer. Usually, the surface of a foam molded article has a countless thin grooves having a depth of 5 μm to 12 μm as shown in FIG. 10, and accordingly has no surface gloss and poor quality in its appearance. In addition, the countless surface microstructures increase the surface area. Therefore, a toner container having such appearance not only has poor quality in its appearance but also has high heat exchange efficiency with respect to the external heat because it has a large surface area, and accordingly is more easily subjected to a thermal influence.

Figure 11:
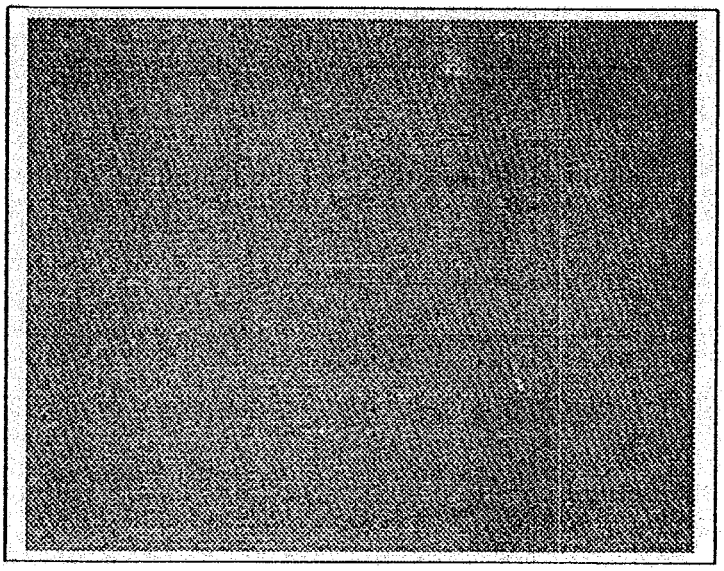
FIG. 11 is a picture of the surface of a toner container having a heat-insulating layer formed of a foam layer.

FIG. 11 is a picture of the surface of a toner container having a heat-insulating layer formed of a foam layer according to the embodiment of the present invention. As shown in FIG. 11, the surface of the toner container of this embodiment is very smooth. As described above, when a foam is used to form the heat-insulating layer, small microstructures such as swirl marks are formed on the surface of the toner container, and accordingly the appearance quality of the toner container becomes poor and the toner container is easily subjected to an external thermal influence due to an increase in surface area. In view of this, according to this embodiment, when injection-molding a resin into a mold, a heat-insulating layer having low thermal conductivity was formed on the surface of the mold to a thickness of 0.1 mm to 0.2 mm, so that the speed with which the resin was cooled to solidify in the mold was decreased. This improved the transfer performance of the surface, thus achieving a smooth surface as shown in FIG. 11. When such a smooth surface was formed, the surface area was decreased, external heat influence was decreased, and the appearance quality could be improved.

Figure 12:
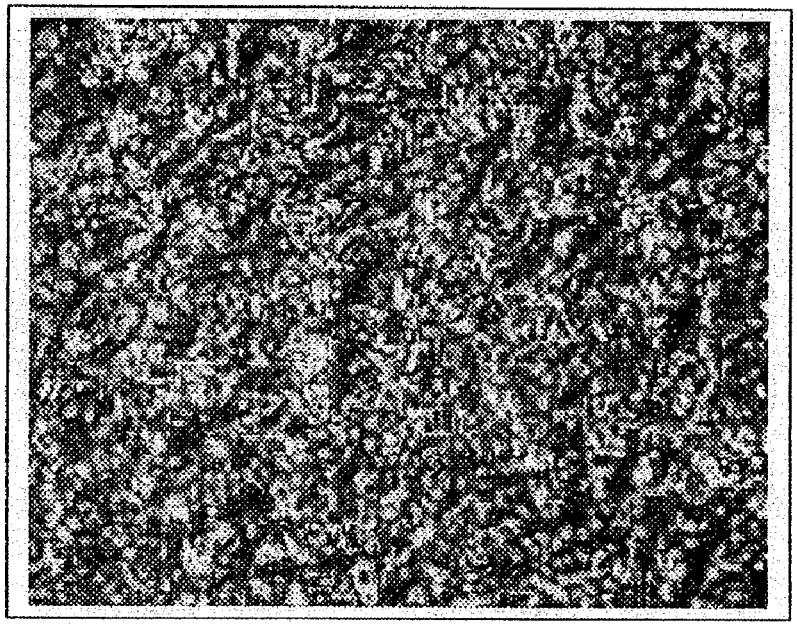
FIG. 12 is a picture of the surface appearance of a toner container including a heat-insulating layer.

FIG. 12 is a picture of the surface appearance of a toner container including a heat-insulating layer according to this embodiment. As described above, when a heat-insulating layer is to be formed from a foam, the appearance is degraded considerably due to swirl marks or the like. According to this embodiment, a wrinkle pattern having an arithmetic average coarseness of 4 μm to 10 μm, a 10-point average coarseness of 15 μm to 35 μm, and an average surface microstructure gap of 150 μm to 350 μm was formed on the surface of the toner container, so that swirl marks were difficult to recognize visually. As a result, a sufficiently high quality can be obtained for the appearance. As the surface area increases due to the swirl marks and wrinkle pattern, the sensitivity to external heat increases, as described above. However, since the composition of the heat-insulating material to be included is optimized, no practical problem is posed.

As described above, according to the above embodiment, since a heat-insulating layer is formed in the toner container, the toner in the container does not agglomerate or fuses even in a high-temperature atmosphere. Also, heat from a fixing unit during printing after the toner container is built in a printer or copying machine main body is blocked, thus obtaining good printing precision. Use of a constant-temperature trailer or packaging material that was used to protect the conventional toner from external heat is reduced, so that the productivity can be improved. Furthermore, since a foam layer is provided as a heat-insulating layer, the weights of components are reduced, so that the cost of the components can be reduced.

As has been described above, according to the above embodiment, even when the toner container is exposed to a high-temperature atmosphere, degradation in printing precision can be prevented with a low cost.

As many apparently widely different embodiments of the present invention can be made without departing from the spirit and scope thereof, it is to be understood that the invention is not limited to the specific embodiments thereof except as defined in the appended claims.

What is claimed is:

1. A toner container being molded from resin material and containing micron-sized toner, the toner container comprising:

an outer surface exposed to outside atmosphere;

an inner surface contacted with the toner; and a large number of cells each having a diameter of 5 μm to 100 μm and existing in the resin material between the outer surface and the inner surface, wherein the outer surface has a wrinkle pattern having an arithmetic average coarseness of 4 μm to 10 μm, a 10-point average coarseness of 15 μm to 35 μm, and an average surface microstructure gap of 150 μm to 350 μm.

2. A toner container being molded from resin material and containing micron-sized toner, the toner container comprising:

an outer surface exposed to outside atmosphere;

an inner surface contacted with the toner; and a large number of cells each having a diameter of 5 μm to 100 μm and existing in the resin material between the outer surface and the inner surface, wherein the inner surface is a fine-discontinuous-microstructure surface and the outer surface is a smooth surface.

* * * * *

UNITED STATES PATENT AND TRADEMARK OFFICE

CERTIFICATE OF CORRECTION

PATENT NO. : 7,209,688 B2
APPLICATION NO. : 10/445259
DATED : April 24, 2007
INVENTOR(S) : Takashi Arai It is certified that error appears in the above-identified patent and that said Letters Patent is hereby corrected as shown below:

ON THE TITLE PAGE:

(56) FOREIGN PATENT DOCUMENTS

| | | |
|---|---|---|
| "JP | 59143170 | 8/1984" should read |
| --JP | 5-9143170 | 8/1984--. |
| "JP | 05169566 | 7/1993 |
| JP | 06149053 | 5/1994 |
| JP | 09327888 | 12/1997 |
| JP | 2000075648 | 3/2000 |
| JP | 20000298394 | 10/2000" should read |
| --JP | 5-169566 | 7/1993 |
| JP | 6-149053 | 5/1994 |
| JP | 9-327888 | 12/1997 |
| JP | 2000-75648 | 3/2000 |
| JP | 2000-298394 | 10/2000--. |

COLUMN 1:

Line 22, "anse" should read --arise--.

COLUMN 2:

Line 7, "is" should read --is characterized--.

Signed and Sealed this

Twenty-fourth Day of March, 2009

John Doll

JOHN DOLL
*Acting Director of the United States Patent and Trademark Office*